US006849799B2

(12) United States Patent
Springer et al.

(10) Patent No.: US 6,849,799 B2
(45) Date of Patent: Feb. 1, 2005

(54) HIGH PROPAGATION SPEED COAXIAL AND TWINAXIAL CABLE

(75) Inventors: Denis D. Springer, Austin, TX (US); Harry A. Loder, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/277,369

(22) Filed: Oct. 22, 2002

(65) Prior Publication Data

US 2004/0074654 A1 Apr. 22, 2004

(51) Int. Cl.[7] ..... H01B 9/06
(52) U.S. Cl. ..... 174/28; 174/113 C; 174/115; 174/15.6
(58) Field of Search ..... 174/28, 113 C, 174/115, 15.6

(56) References Cited

U.S. PATENT DOCUMENTS

| | | | | |
|---|---|---|---|---|
| 2,038,973 A | * | 4/1936 | Wentz | 174/29 |
| 2,210,400 A | * | 8/1940 | Fischer et al. | 174/28 |
| 2,599,857 A | * | 6/1952 | Mildner | 264/145 |
| 2,890,263 A | | 6/1959 | Brandes et al. | |
| 3,864,509 A | * | 2/1975 | Gommans | 174/28 |
| 4,011,118 A | * | 3/1977 | Geominy | 156/51 |
| 5,107,076 A | | 4/1992 | Bullock et al. | |
| 5,262,593 A | | 11/1993 | Madry et al. | |
| 5,532,657 A | | 7/1996 | Stoehr et al. | |

OTHER PUBLICATIONS

"High Speed Coax & Twinax", Temp–Flex Cable Inc., 26 Milford Road, S. Grafton, MA 01560, [retrieved from the internet Aug. 29, 2003], URL<http;//www.tempflex.com/products/hscoax.asp and http://www.tempflex.com/datasheets/hscoax.html >, pp 2.

* cited by examiner

*Primary Examiner*—Dean A. Reichard
*Assistant Examiner*—Jinhee Lee
(74) *Attorney, Agent, or Firm*—Melanie G. Gover

(57) ABSTRACT

The amount of air dielectric in air core coaxial and twinaxial cables is increased by spacer structures installed between the center conductor and the outer shield which have provision for air voids or pockets running lengthwise. The extra air space provides lower effective dielectric constant for the cable. In one embodiment, a single-element extruded spacer is formed with air cavities or voids that run continuously throughout the length of the spacer. Several spacer "profiles" or cross-sections are disclosed that place less solid dielectric mass in proximity to the center conductor. The result is a greater volume of air dielectric, and hence a lowered cable dielectric constant. In a further embodiment the spacer is a circular cross-sectioned element consisting of a central dielectric strength member surrounded with foamed material. Strength strands such as Kevlar® may be added to the spacer.

32 Claims, 6 Drawing Sheets

HIGH PROPAGATION SPEED COAXIAL AND TWINAXIAL CABLE

TECHNICAL FIELD

This invention relates to air core coaxial and twinaxial cables; and more particularly to improved structures for spacing the inner conductor from the outer conductor or shield in these cable constructions to achieve a low-loss cable having increased signal propagation speed.

BACKGROUND OF THE INVENTION

Air core coaxial cables basically consist of an insulated signal conductor and a metallic outer shield separated from the inner conductor by a dielectric spacer. Air core twinaxial cables basically consist of two insulated signal conductors separated by dielectric spacers from a common metallic shield. In both designs, typically a core tube is included between each spacer and the surrounding metallic outer shield.

For many coaxial and twinaxial cable applications, achieving high signal propagation speed with less susceptibility to signal loss and distortion is a critical requirement. Examples of such applications include low-loss UHF/microwave interconnect cable, wireless telephony base station interconnect cable, semiconductor device testing equipment; instrumentation systems, computer networking; data communications, and broadcasting cable. For example, some coaxial cable designs for use in semiconductor testing require that the signal strength attenuation in dB per 100 ft. of cable be kept at or below 10 at frequencies of 6,000 MHz. Using larger conductors reduces cable attenuation; but to keep cable size small, low dielectric constant components are necessary.

High propagation speed coaxial and twinaxial cables of the prior art have used a variety of designs. In general, designers want to use as large an inner conductor diameter as possible since signal loss varies inversely with increasing conductor diameter. Larger inner conductor diameter sizes typically require larger volumes of dielectric spacer around the inner conductor to maintain the desired cable impedance. In order to maintain cable dimensions, this must be offset with increasingly lower overall dielectric constant values for the interior space separating the inner and outer conductors.

High-speed air core cable designs seek to maximize the air content between the inner and outer conductors, thus to realize the benefit of air as the ideal dielectric. Of course, air alone cannot supply structural stability; and therefore some relatively solid dielectric spacer must be included in an "air core" cable. These dielectric structures, while maximizing the air content, must meet a host of other requirements including: reliably uniform separation between the inner and outer conductors; resistance to deformation and crushing; heat resistance; ease of manufacture; and low cost. This combination of characteristics has proven difficult to realize commercially, as the following prior art illustrates.

U.S. Pat. No. 5,532,657 issued Jul. 2, 1996 discloses a coaxial cable in which an inner conductor and an outer conductor are separated by spirally-wrapped filament composed of low dielectric constant material such as polyolefins, polytetrafluoroethylene (PTFE) or mineral fibers. The filament may be a mono-filament or alternatively a dual-filament twisted pair. The filaments disclosed are circular in cross-section. The remaining space within the cable is air-filled, creating a dielectric area within the cable having lowered dielectric constant.

IBM Technical Disclosure Bulletin Vol. 32, No. 6A, November 1989 at p. 173–174, referred-to in U.S. Pat. No. 5,532,657, discloses a construction of coaxial cable where two individual filaments are spirally wrapped around a single center conductor in counter-directions and at different wrapping rates. The multiple crossings of the filaments are said to provide a stable symmetrical cross-section; and the interstices assure a large fraction of air dielectric in the cable. A similar construction using a twisted pair of filaments spirally wrapped around the center conductor is found in a coaxial cable product made by Temp-flex Inc. of So. Grafton, Mass. This twisted pair spacer is not in continuous contact with the center conductor, and therefore allows more air dielectric to contact the surface of the inner conductor.

The circular monofilaments have the drawback of placing circular cross-sectioned solid dielectric in close proximity to the inner conductor and thus increasing the effective dielectric constant of the cable. Further, while the twisted pair dielectric spacers of the prior art use less dielectric mass than a solid circular core monofilament—typically about 50% less mass—their manufacture requires providing two filaments instead of one, and having to use a complex twisting apparatus.

Foamed coaxial and twinaxial cable spacers are also found in the prior art. An early teaching in U.S. Pat. No. 2,890,263 issued Jun. 9, 1952 describes a UHF coaxial cable having an inner and outer corrugated conductor spaced apart in a first embodiment by a helically wrapped polyethylene or polystyrene strip selected for its low dielectric constant. The strip is shown as a solid core ellipsoid, which places dielectric mass close to the inner conductor. U.S. Pat. No. 2,890,263 also shows filling the interior space between inner and outer conductors entirely with foamed plastic material.

Greater durability and heat resistance for low-k spacer materials is provided by a process for introducing porosity in PTFE. U.S. Pat. No. 5,107,076 issued Apr. 21, 1992 shows a coax cable with a center conductor having tape-wrapped ribbons of porous or expanded PTFE fibers wrapped around it. Over this assembly is a tube or a tape-wrap of FEP; followed by an enclosing conductive metal layer. However, substantial dielectric mass is still positioned close to the center conductor in this design.

The need exists for both coaxial and twinaxial cables having propagation speeds greater than 1.22 Ns/ft.; and preferably of 1.15 Ns/ft. or less. In realizing such greater propagation speed, however, the cable designs should be attainable with a variety of spacer filaments either of the solid core design or of the foamed type, thus to provide a maximum of cable design flexibility. At the same time, the cost of manufacturing of these type cables must be as low as possible.

SUMMARY OF THE INVENTION

This invention provides a set of spacer structures useable in either coaxial or twinaxial air core cable construction, which improve over dielectric monofilament spacers or twisted pair spacer filaments of prior art coaxial or twinaxial cables, as well as over spacers which use foam to increase air as a dielectric medium. According to the invention, a unitary, single-element spacer using air cavities or voids formed continuously throughout the length of the spacer features a cross-section that, relative to prior art spacers, places less solid dielectric mass in proximity to the center conductor. Although using less solid material, the spacers of the invention still maintain a pre-determined and uniform spacing of the outer conductor from the center conductor.

The spacer embodiments below are mainly illustrations in the air core coaxial cable art; but it is understood that two coaxial cables made according to any of the described spacer concepts may be incorporated into a twinaxial cable design with equally beneficial results.

In a first embodiment, the spacer is an elongate unitary dielectric extrusion, installed in a spiral wrap around the inner conductor and twisted around its own axis. Typically, a tube of dielectric material is extruded over the spacer; and an outer conductor or shield is applied over the tube. An outer jacket then is placed over the shield. The spacer may have any one of several uniform cross-sectional or "profile" shapes. The profiles differ from a conventional circular cross-sectioned spacer in that material is omitted from one or more regions, thus to create less area of cross-section. All profiles have in common the forming, out of the omitted material, of one or more air corridors which run continuously throughout the length of the spacer. The corridors may be formed into the exterior surface of the spacer, or formed as internal corridors; or both. All profiles are chosen to keep solid dielectric relatively further away from the center conductor. The profiles preferred have from about 40% to 65% of the dielectric material of a circular solid core spacer of the prior art.

Examples of the filament profiles according to the first embodiment of the invention as illustrated hereinafter, include various "dumbbell" shapes, "figure-8" shapes and air corridor(s) formed in the spacer interior symmetrically around the filament axis. Dumbbell and figure-8 profiles have the advantage that contact between the spacer and the inner conductor is intermittent depending on the profile chosen and the pitch of the spiraling and the twisting. In one example, the points of contact form a dotted line as opposed to continuous solid line contact between inner conductor and a solid core circular spacer. Less contact between the spacer and inner conductor advantageously lowers the overall cable dielectric constant.

The twinning step during manufacture of the prior art dual filament spacers, is completely avoided by the unitary feature of the dumbbell and figure-8 spacers. Importantly also, the profiles can be modified to change the aspect ratio of horizontal to vertical dimension of the filament from, for example, 2:1, to 3:1 or to 1.5:1. Latitude in selection of aspect ratios permits optimization of electrical parameters such as cable impedance, capacitance and propagation delay. This advantageous parameter optimization cannot be accomplished as readily with the prior art twisted pair spacer.

In a second embodiment, the air cavities or voids are provided by a foamed polymer material extruded over a relatively small diameter core. The core may be a single solid filament; or alternatively may be formed using several stranded fibrous members composed of, for example, Kevlar®. A tube of dielectric material typically is extruded over the foamed material. The core serves as a reinforcing member both during and after the foaming process. Instead of placing foamed material into the entire volume between the inner conductor and outer shield as in prior art use of foamed dielectric, the combination of a reinforced foamed spacer and dielectric tube according to the second embodiment requires far less mass by a factor of from 50% to 80%. As in the first embodiment, this unitary structure is spirally applied in the installation process. By keeping the core small and away from the center conductor, the filament has little impact on the effective dielectric constant of the completed cable.

In addition, the second embodiment has advantages over both the 100% solid foam fill or the twisted pair filaments of the prior coaxial and twinaxial cable art. Specifically, since the percent of air content can be controlled, dimensions of the cable can be maintained while cable impedance, capacitance and propagation delay can be adjusted simply by varying the percent of air in the foamed filament or by varying the lay length of the foamed filament. In addition, the relatively consistent diameter of the foamed spacer of the second embodiment provides a more complete support (as opposed to intermittent support) for the tube placed over the foamed spacer. The tube thus is spaced more uniformly with respect to the cable conductors, reducing the incidence of small capacitance changes and thereby reducing attenuation by achieving a more constant impedance.

The solid profile spacer and the reinforced foamed spacer have in common several characteristics. Both embodiments comprise a single unitary structure that can be applied in manufacture directly around the center conductor. Both require only two, rather than three, extrusion processes for manufacture of the primary insulations; and both eliminate the twinning process of the twisted pair filament. Both embodiments create voids that are occupied by air instead of solid dielectric. The air voids are placed uniformly along the length of the spacer. Further, both embodiments use less mass than solid unitary filaments of the prior art. Because of the cross-sections selected, both embodiments of the invention place less dielectric at or near the center conductor. What contact there is with the spacer and the inner conductor, is line contact in the case of the foamed dielectric and other circular cross-section profiles; or dotted line contact in the cases of dumbbell, figure-8 and like-shaped profiles. Both embodiments reduce the effective dielectric constant of the cable; and the reinforced foamed spacer provides the additional advantage of lower cable loss.

BRIEF DESCRIPTIONS OF THE INVENTION

FIGS. 6*a*, 6*b*, 6*c*, 6*d*, 6*e*, 6*f*, 6*g*, 6*h*, 6*i*, 6*j*, 6*k*, 6*l* and 6*m* are cross-sectional diagrams illustrating various specific "profiles" and details of solid elongate extruded dielectric spacers.

Figure 7:
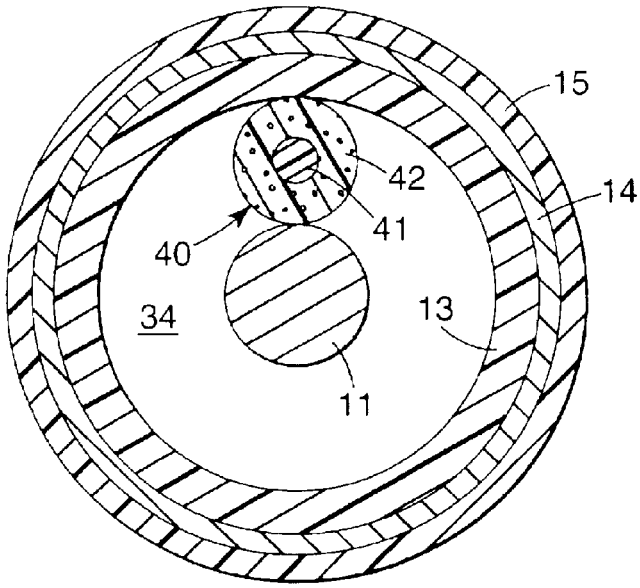

FIG. 7 is a cross-sectional view of a coaxial cable using a foamed or expanded spacer.

Figure 8:
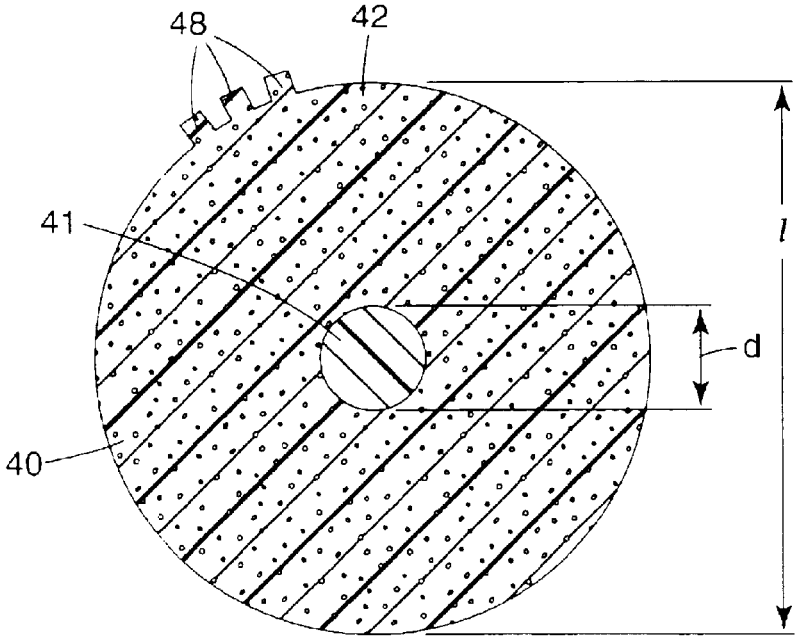

FIG. 8 is a cross-sectional view of an illustrative expanded spacer.

Figure 9:
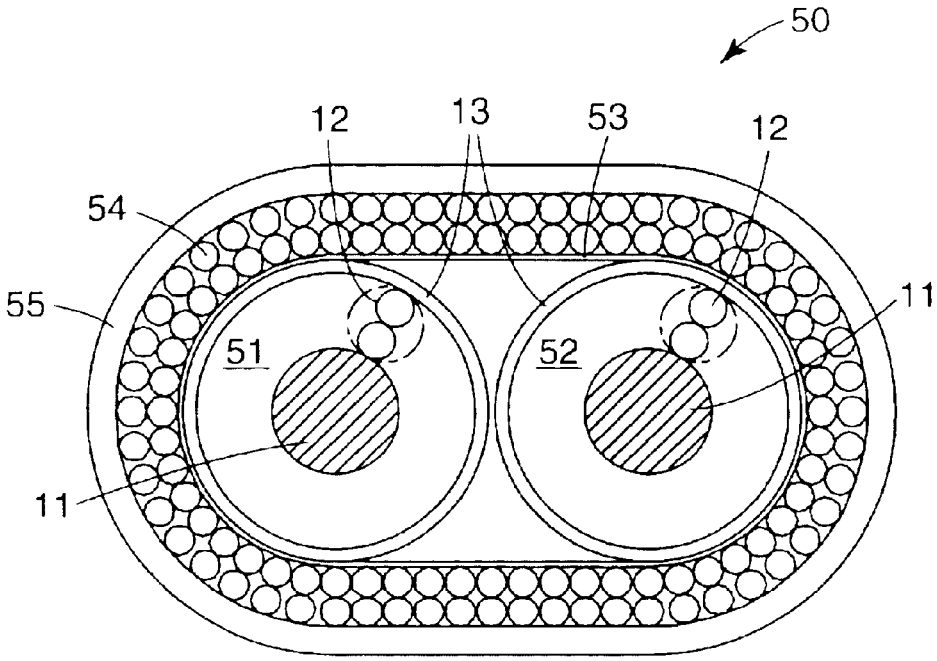

FIG. 9 is a cross-sectional view of a twinaxial cable constructed according to the invention.

Figure 10A:
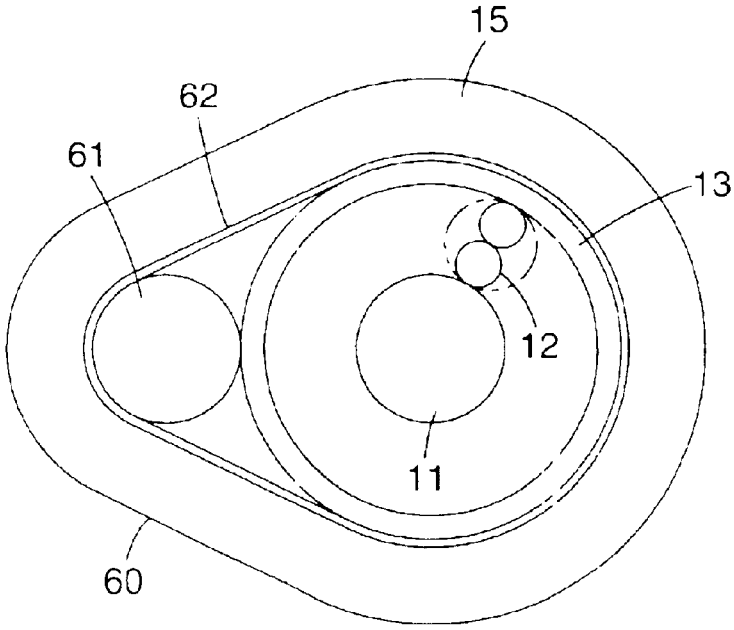
Figure 10B:
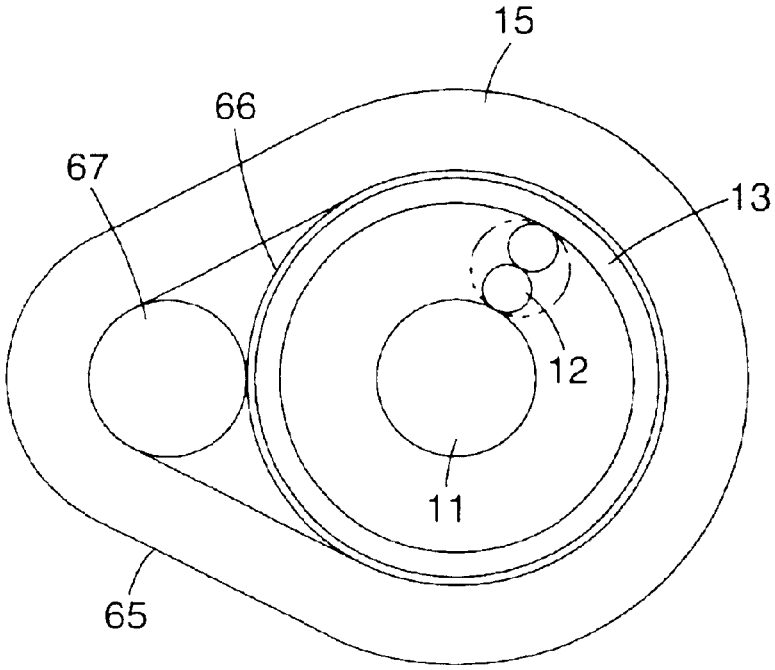
Figure 10C:
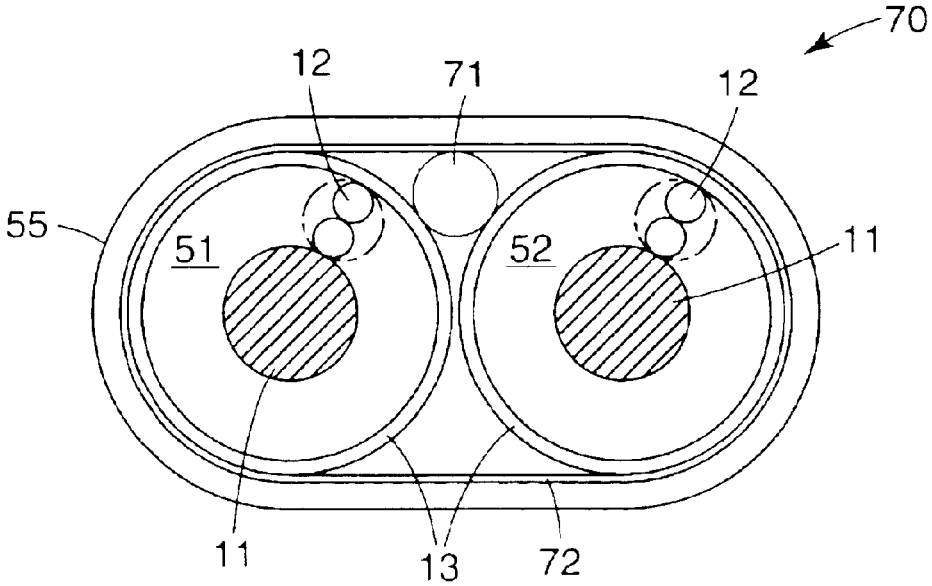

FIGS. 10*a*, 10*b* and 10*c* are cross-sectional views showing the invention in coaxial and twinaxial cables which use drain wires.

DETAILED DESCRIPTION OF THE ILLUSTRATIVE EMBODIMENTS

Figure 1:
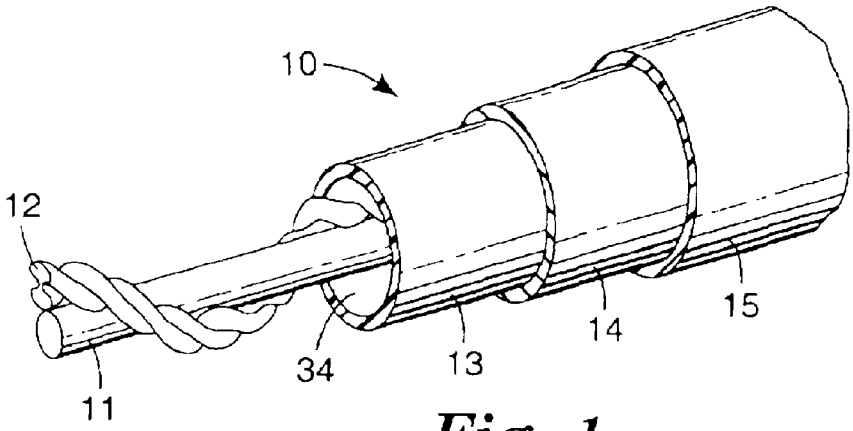
FIG. 1 is a partial sectional side perspective view of a coaxial cable using an illustrative solid elongate dielectric spacer of the invention.
Figure 4:
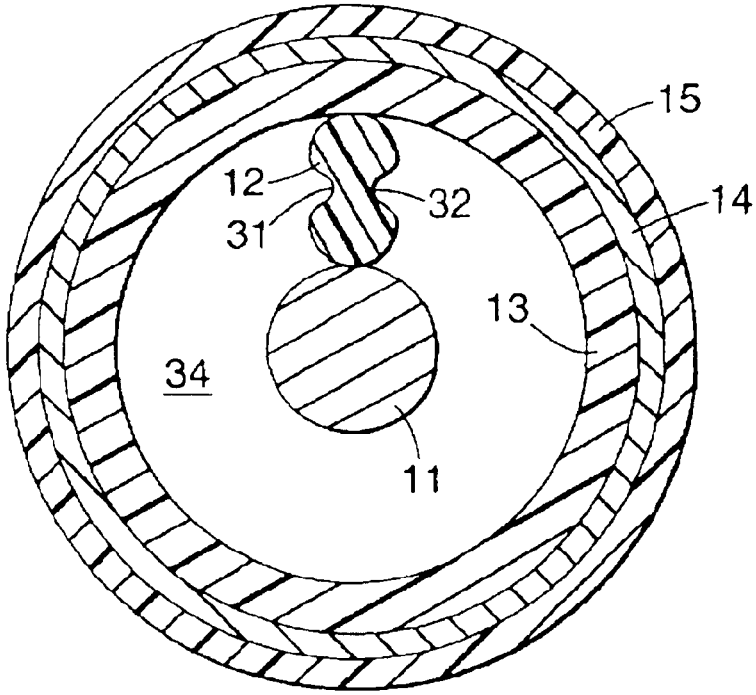
FIG. 4 is a cross-sectional view of the cable of FIG. 1

FIGS. 1 and 4 show an air core coaxial cable 10 constructed in accordance with a first embodiment of the invention. Cable 10 has an inner conductor 11, and a solid core filament spacer 12 that is twisted around its own axis and then helically wound around inner conductor 11. Dielectric tube 13 is formed around spacer 12. Outer conductor or shield 14 is formed on top of tube 13, and an outer plastic jacket 15 is applied around shield 14.

As with all spacers of the first embodiment, spacer 12 in FIGS. 1 and 4 is formed with substantially less cross-sectional area than a spacer of circular cross-section with an equivalent spacing characteristic. Spacer 12 has a "dumbbell" profile; but its profile may alternatively have any of the "profiles" hereinafter specifically illustrated, or other "profiles" of equivalent nature which practitioners in the art can realize. Advantageously, spacer 12 is formed by extrusion, a process which is well-suited to creating numerous different "profiles".

Figure 2:
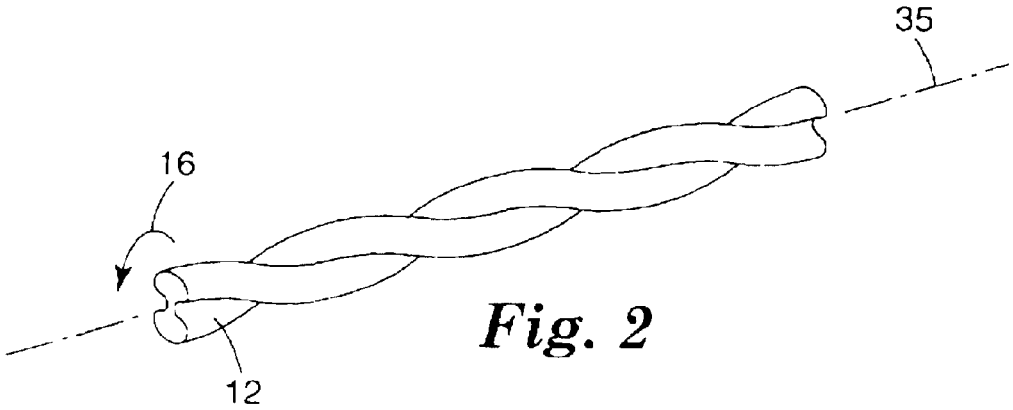
FIGS. 2 and 3 are side perspective views showing respectively a spacer being twisted around its own axis and thereafter being spirally wrapped around a center conductor.
Figure 3:
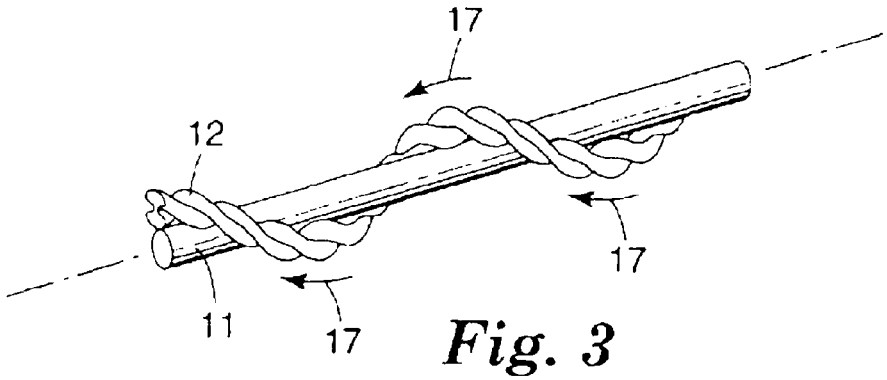

The surfaces of spacer 12 at the spacer's greatest cross-section dimension are rounded to reduce the area of contact between spacer 12 and inner conductor 11. Referring now to FIGS. 2 and 3, during manufacture as spacer 12 is helically wound along inner conductor 11 in a direction denoted by arrows 17, spacer 12 concurrently is twisted around its own center axis 35 in a direction denoted by arrow 16. As a result of the twisting, where the rounded ends of spacer 12 are in contact with inner conductor 11, dielectric tube 13 maintains spacer 12 and inner conductor 11 in close contact. Because of the twisting, however, the ends of spacer 12 periodically twist out of contact with the surface of inner conductor 11. Thus, the locus of actual mutual contact between spacer 12 and inner conductor 11 is intermittent and forms in effect a dotted line. This intermittent physical contact between spacer 12 and inner conductor 11 is advantageous, however, because less such contact means that more air is presented between inner and outer conductors; and hence the overall impedance of the cable is improved.

Figure 6A:
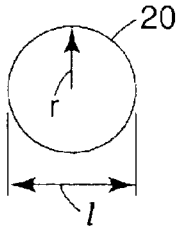
Fig. 6a PRIOR ART
Figure 6B:
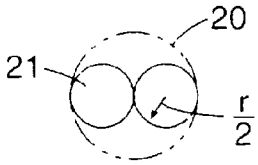

To demonstrate the profile variations permissible within the first embodiment of the invention, and the interesting differences among the profiles, FIGS. 6*a* through 6*m* are next presented. Referring first to FIG. 6*a* which represents prior art, if the area of the circular cross-sectioned profile 20 of radius "r" is set at 3.1415 units, then the area of the profile 21 of FIG. 6*b* consisting of two circular cross-sectioned filaments each of radius r/2, is 1.570 units. Profile 21 therefore provides a 50% reduction in cross-sectional area over profile 20. Thus a spacer made in the general shape of profile 21 will take up substantially 50% less volume than the profile 20 of FIG. 6*a* when placed within the interior volume 34 of cable 10, creating more volume for air dielectric. The maximum cross-sectional dimension of profile 21 is seen to be the same as the diameter of prior art profile 20 superimposed for illustration onto profile 21.

Figure 6C:
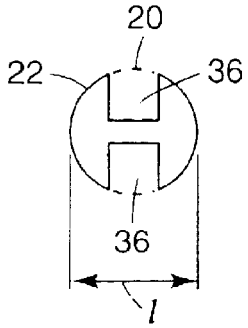

The profile denoted 22 in FIG. 6*c* is an example of numerous possible "dumbbell"-shaped cross-sections. Its maximum dimension "1" is chosen to be the diameter of an equivalent circular cross-section spacer such as profile 20. Profile 22 is made with a pair of opposed, relatively deep narrow rectilinear cross-section notches 36 formed along its exterior, each forming an air corridor when placed around an inner conductor of a coaxial cable. If profile 22 is formed so that its area is 2.00 units, profile 22 will constitute about 65% of the area of profile 20. Contact between profile 22 when applied in a twist to inner conductor 11 is more frequent than for profile 21.

Figure 6D:
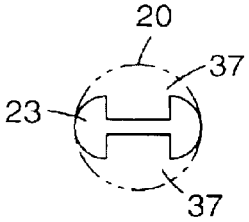

The "dumbbell" profile denoted 23 shown in FIG. 6*d* uses rectilinear cross-section notches 37 for forming air corridors that are both wider and deeper than notches 36 of profile 22. The curved regions of the filament's exterior surface which contact dielectric tube 13 are circles of a lesser radius than that of profile "r" of FIG. 6*a*. The cross-sectional area of profile 23 typically may be about 44% that of profile 20. Because of its lesser radius, profile 23 when formed as a helically wound and twisted spacer around a center conductor will contact the center conductor more intermittently than profile 22.

Figure 6E:
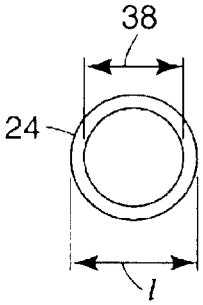

The profile 24 shown in FIG. 6*e* is pipe-shaped in cross-section, with an outer diameter "1" equal to the diameter of the circular profile 20 of FIG. 6*a*. The inner diameter 38 of profile 24 may be set so that the solid mass of its cross-sectional area is about 44% that of profile 20.

Figure 6F:
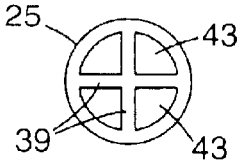

A variant of the pipe-shaped profile of FIG. 6*e* is shown as profile 25 in FIG. 6*f*. Two elongate walls 39 formed at right angles to each other in the interior of profile 25 create four longitudinal interior corridors 43 symmetrically about the center axis of the profile. This profile may be formed to employ typically about 49% of the solid mass of profile 20; and because of the reinforcing provided by walls 39, is more crush-resistant than profile 24.

Figure 5:
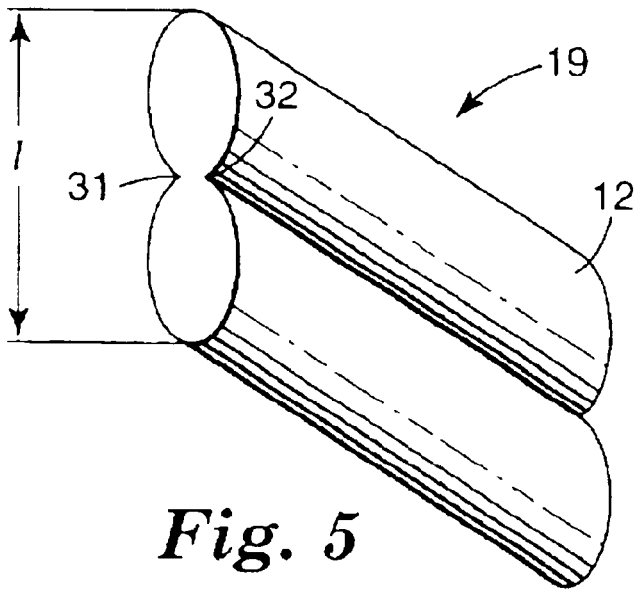
FIG. 5 is a side perspective view of an illustrative unitary solid extruded spacer.
Figure 6G:
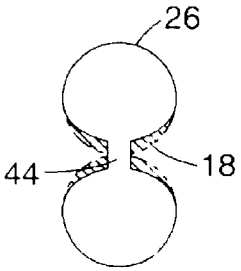
Figure 6H:
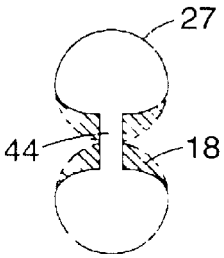
Figure 6I:
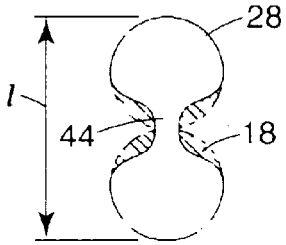

FIG. 5 shows another exemplary filament 19, an extruded "figure-8" profile with the narrowed waist portion forming lengthwise exterior air corridors 31, 32. Corridors 31, 32 create additional space for air dielectric to be contained within the interior volume 34 of cable 10. FIGS. 6*g*, 6*h* and 6I show further variants of the "figure-8" profile, wherein the basic profile is formed by two circular cross-sections connected with a bridge 44. These profiles differ from one another by the amount and location of removed dielectric denoted 18. Profile 26 in FIG. 6*g* is designed so that portions of its dielectric where the circular cross-sections join with bridge 44 are omitted in the extrusion process. For profile 27 in FIG. 6*h*, a greater portion of the mass in this same area is omitted. For the profile 28 in FIG. 61, the angular joint formed by the intersections of the two circles and the joining bridge 44 is smoothed out, which requires somewhat more solid dielectric mass than for profile 27.

Figure 6J:
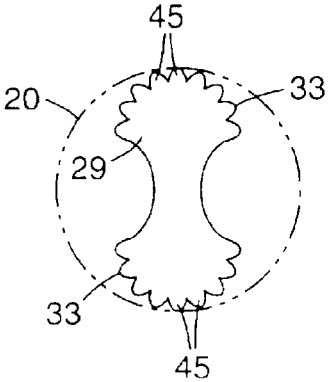

A variation on the profiles 26, 27 or 28 is shown as profile 29 in FIG. 6*j*. The tube-contacting surfaces 33 of the two end-sections, instead of being formed as a smooth surface as with profiles 22 or 23, comprise a series of elongate, parallel round-edged ribs 45. Profile 29 offers the advantage of less direct contact with center conductor 11 and hence a lower overall dielectric constant.

Figure 6K:
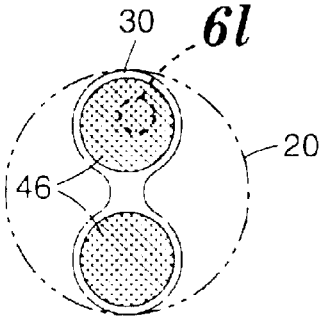
Figure 6L:
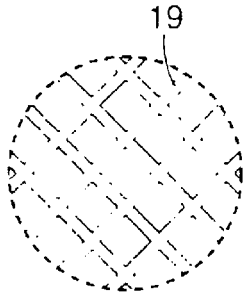
Figure 6M:
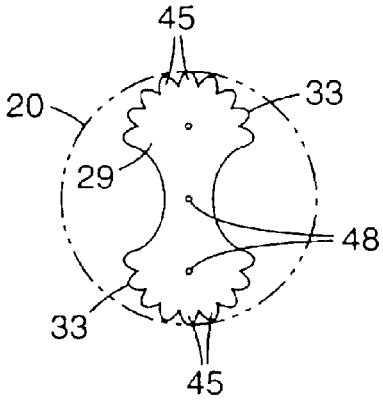

The profile 30 shown in FIG. 6*k* is a variation on the profile 28 of FIG. 6*i*. Profile 30 may be formed with an interior longitudinal air core 46 within each end. The rigidity of the air cores 46 may be strengthened by using some buttressing structure within the cores, such as the honeycombing 47 shown in FIG. 6*l*.

The embodiments of spacer 12 so far described are unreinforced unitary extrusions, the advantage to which is ease of manufacture and assembly into a coaxial cable. A useful variation, however, is to include one or more strength members into any of the exemplary extrusions, such as the fibers 48 shown in FIG. 6*m*. While many choices of strength member are available, a preferred choice is the DuPont product Kevlar® because of its very high tensile strength and low thermal shrinkage. Strength member 48 may be included in any of the described profiles.

If one or more strength members 48 are included in any the above-described embodiments, then in accordance with a further variation of the invention the spacer 12 instead of being a solid extrusion may consist of expanded materials of the type described below in the second embodiment.

A wide range of materials may be used to fabricate extruded spacers 12, including flouoropolymers such as perfluoroalkoxy (PFA) and fluorinated ethylene propylene (FEP); and polyolefins such as polyethylene (PE), polypropylene (PP) and polymethyl pentane. Of these, a preferred choice is PFA because of its low dielectric constant and dissipation factor.

By way of example, a 50 ohm coaxial cable constructed in accordance with the first embodiment of the invention consists of a silver-plated stranded copper inner conductor 11, an extruded dielectric spacer 12 of PFA material, a tube 13 of FEP material, an outer conductor 14 of silver-plated copper wire braid and an outer jacket 15 of FEP. Inner conductor 111 has a diameter of 0.48 mm. Spacer 12 has a profile substantially as shown in FIG. 6*d*. The longest dimension of spacer 12 in this example is 0.25 mm. The outer diameter of tube 13 is 1.1 mm. A coaxial cable thus constructed may be expected to have a propagation delay better than an otherwise identical cable constructed with the prior art dual filament spacer 21 illustrated in FIG. 6*b*. The improvement may be 0.016 picoseconds per meter, or more, depending on the profile (as in, for example, FIGS. 6*d*, 6*g*, 6*h* and 6*i*) selected to vary the air content of the cable core. It is understood that other diameter choices for inner conductor 11 can be made with commensurate changes in the dimensions of spacer 12 and tube 16 to achieve the same characteristic impedance and propagation delay.

Turning now to the second embodiment of the invention, FIG. 7 shows a coaxial cable identical to the cable 10 of FIG. 4 except that the dielectric center spacer is a filament 40 comprising a core 41 with expanded material 42 applied around the core. Materials suitable for forming a solid core 41 include polyesters, PFA, and polyimides selected for their heat resistance and strength. Alternatively, core 41 may be formed in whole or in part with fibrous members to provide added tensile strength for filament 40. A preferred choice of fibrous material for core 41 is Kevlar®. The expanded material 42 is characterized by trapped air pockets disbursed uniformly along the length of filament 40, so that any given cross-section will have about the same proportion of air pockets as any other. Expanded FEP material is a preferred choice; but other expandable materials may include polyolefins selected for their low dielectric constant and thermoplastic properties. The process for forming the expanded material is well-known in the art and may consist of introducing a chemical or gaseous blowing agent into the polymer during extrusion as described, for example, in U.S. Pat. No. 4,104,481.

As shown in detail in the example of FIG. 8, the diameter "1" of filament 40 corresponds to the diameter "1" of prior art solid core filament 20 shown in FIG. 6*a* with equivalent spacing characteristic. The shape of filament 40 does not have to be round or circular in profile. Alternative profiles for filament 40 may include profiles similar to that depicted in FIG. 6*c*, for example; or stranded cores. Useful non-circular profiles for filament 40 that provide lower cable impedance are more attainable when material such as Kevlar® is used in core 41 to provide tensile strength.

A variation on the circular outer surface of the expanded material 42, is to provide plural elongate spaced ribs 48 on the outer surface for contacting inner conductor 11 as illustrated in FIG. 8. This expedient reduces the physical contact between the foaming material and inner conductor 11; and thereby increases cable impedance while reducing dielectric constant.

For the circular embodiment shown in FIG. 8, the much smaller diameter of core 41 denoted "d" of filament 40, is set to within a range of from about 0.0005 inches to 0.010 inches to help increase extrudability and usability of the expanded structure without unduly adding dielectric solid mass that will decrease cable impedance, increase loss and increase dielectric constant. The diameter "1" sets the desired separation between inner conductor 11 and outer shield 14, after taking into account the thickness of dielectric tube 13. As with the first embodiment, filament 40 is helically applied around inner conductor 11.

The core 41 is spaced from center conductor 11 by an average distance of about (1−d)/2; and therefore has only secondary impact in setting the effective dielectric constant of cable 10. Primarily impacting the cable's dielectric constant in this embodiment, is the outer dimension "1" and the percent air placed in foamed material 42. Once dimension "1" is set for a given cable design and choice of expanded material, the percent air in the expanded material advantageously can be varied to adjust cable parameters including propagation delay, impedance and capacitance secondary impact in setting the effective dielectric constant of cable 10. Primarily. Typically, the percent of air may be varied from about 40% to 60% by volume.

In all embodiments, the lay length of the spacer 12 or 40 is determined by weighing decreasing of the lay lengths (which will provide greater support and dimensional stability to the outer conductor 14) against the decreased cable impedance that will result from smaller lay lengths.

FIG. 9 illustrates an application of the above-described spacers to an air core twinaxial cable 50. Twinaxial cables generally consist of two signal lines which are used for balanced or differential signaling. Twinaxial cable 50 comprises two assemblies 51, 52 which typically although not necessarily are identical in construction. Each of the assemblies 51, 52 comprises an inner conductor 11, a dielectric spacer 12, and a dielectric tube 13. The two assemblies 51, 52 are placed in close proximity to each other; and preferably, although not necessarily, are enveloped with a metallic foil shield 53. Next, a metallic wire shield 54 may be applied to surround the assemblies 51, 52. Finally, an outer jacket 55 is applied around metallic shield 54. The inner conductors 11 may be formed of bare copper, tinned copper, copper-covered steel, or aluminum and may be either stranded or solid. The metallic shield 54 may be formed of braided copper. The tube 13 and outer jacket 55 are formed of FP, FFEP (foamed Fluorinated Ethylene Propylene), PE., or PVC. In accordance with the embodiment of FIG. 9, dielectric spacers 12 may be formed with any of the profiles heretofore described and shown, for example, in FIGS. 6*b* to 6*m*. The spacer 12 filaments are twisted around their own axis, and then usually stranded around inner conductor 11 as in earlier examples.

The invention may also be used in coaxial cable or twinaxial cable which contain a metal foil in place of the braided or served outer shield 14 in the coaxial cable of FIG. 4; or in place of the metallic shield 54 of the twinaxial cable of FIG. 9. In these designs, a drain wire is placed either between the core and the metal foil or between the metal foil and the outer jacket.

To illustrate, FIG. 10*a* shows a coaxial cable 60 constructed of inner conductor 11, spacer 12 and dielectric tube 13. A drain wire 61 is placed outside tube 13. A metal foil 62 is placed around drain wire 61 and tube 13. Outer jacket 15 is placed around metal foil 62. The coaxial cable 65 of FIG. 10*b* differs from that of FIG. 10*a* only in that its metal foil 66 is placed only around tube 13 and does not envelop drain wire 67.

FIG. 10*c* illustrates a twinaxial cable 70 with two assemblies 51, 52 as in FIG. 9, each comprising inner conductor 11, spacer 12 and tube 13. A drain wire 71 is placed in one of the spaces alongside tubes 13. A metal foil 72 is placed around the tubes 13 and drain wire 71. Alternatively, drain wire 71 may be placed outside of the envelop of metal foil 72 (not shown). In either design, outer jacket 55 is placed around the structure's exterior.

Computer models were constructed to assess the propagation delay characteristic of several coaxial cables using specific spacers described above, including the spacer profiles of FIGS. 6*c*, 6*d*, 6*e* and 8. The models required that the dimension "1" (which sets the outer diameter of the tube 13) is held constant. The findings were that propagation delay was comparable to a coaxial or twinaxial cable using a twisted pair filament as a spacer; and in at least one instance propagation delay was actually less. Importantly, however, all spacers 12 of the present invention reduce the cost and complexity of manufacture by their essential unitary structure.

What is claimed is:

1. A high signal propagation speed cable comprising at least one air core coaxial cable, said coaxial cable comprising: a) a metallic inner conductor; b) a longitudinal unitary extruded dielectric spacer helically applied along said inner conductor and comprising a substantially uniform transverse cross-section shaped to create air voids throughout the length of said spacer wherein said cross-section comprises first and second circular cross-section portions, said cross-section portions being joined by a bridge in between two air voids, one of the air voids formed on the opposite side of the other of the two air voids providing low dielectric constant for the cable; c) a dielectric tube formed atop said spacer; d) a metallic outer shield; and e) an outer jacket enveloping said outer shield.

2. A high signal propagation speed cable in accordance with claim 1, wherein said longitudinal dielectric spacer is an extruded unitary filament; and said voids comprise one or more corridors of uniform cross-section running the length of said filament.

3. An air core cable in accordance with claim 2, wherein said corridors are formed within the interior of said filament.

4. A high signal propagation speed cable in accordance with claim 2, wherein said corridors are formed along the outer surface of said filament.

5. A high signal propagation speed cable in accordance with claim 2, wherein the transverse cress-section of said dielectric spacer has an area comprising from 40% to 65% of the area of an equivalent spacer having a circular cross-section.

6. An air core cable in a accordance with claim 5, wherein said profile comprises a unitary two-ended dumbbell; said two ends being joined by a bridge formed by first and second opposing rectilinear notches.

7. An air core cable in accordance with claim 6, wherein each said end has a radius of curvature substantially the same as the radius of curvature of an equivalent solid circular cross-section spacer.

8. An air core cable in accordance with claim 6, wherein each said end has a radius of curvature less than the radius of curvature of an equivalent solid circular cross-section spacer.

9. A high signal propagation speed cable in accordance with claim 1, wherein said bridge joining said cross-section portions is formed by first and second opposing notches.

10. A high signal propagation speed cable in accordance with claim 9, wherein said first and second opposing notches are rectilinear.

11. A high signal propagation speed cable in accordance with claim 9, wherein said first and second opposing notches are curvilinear.

12. A high signal propagation speed cable in accordance with claim 1, wherein at least one of said cross-section portions has a radius of curvature substantially the same as a radius of curvature of an equivalent solid circular cross-section spacer.

13. A high signal propagation speed cable in accordance with claim 1, wherein at least one of said cross-section portions has a radius of curvature less than a radius of curvature of an equivalent solid circular cross-section spacer.

14. An air core cable in accordance with claim 5, wherein said profile is pipe-shaped; the outside diameter of said pipe-shape being substantially the same as the diameter of an equivalent solid circular cross-section spacer.

15. An air core cable in accordance with claim 14, further comprising one or more interior elongate walls connecting to the interior surface of said pipe-shaped profile.

16. A high signal propagation speed cable in accordance with claim 2, wherein said dielectric spacer is composed of material selected from the group consisting of flouoropolymers and polyolefins.

17. A high signal propagation speed cable in accordance with claim 2, wherein said dielectric spacer is composed of material selected from the group consisting of perfluoroalkoxy, fluorinated ethylene propylene, polyethylene, polypropylene and polymethyl pentane.

18. A high signal propagation speed cable in accordance with claim 2, wherein said dielectric spacer is composed of perfluoroalkoxy.

19. An air core cable in accordance with claim 2, wherein said dielectric spacer further comprises one or more elongate strength members disposed along the length of said spacer.

20. An air core cable in accordance with claim 19, wherein said dielectric spacer further comprises expanded material.

21. An air core cable in accordance with claim 1, wherein said dielectric spacer comprises a dielectric core and expanded material surrounding said core; said expanded material forming said air voids in a uniform disbursement along said spacer.

22. An air core cable in accordance with claim 21, wherein said dielectric core comprises one or more fibrous members.

23. An air core cable in accordance with claim 21, wherein said dielectric core is comprised of solid material selected from the group consisting of fluoropolymers, polyesters and polyimides.

24. air core cable in accordance with claim 21, wherein said solid material is perfluoroalkoxy.

25. An air core cable in accordance with claim 21, wherein said dielectric core and said expanded material are each circular in cross-section.

26. An air core cable in accordance with claim 25, further comprising plural elongate spaced ribs formed on the outer surface of said expanded material.

27. An air core cable in accordance with claim 21, wherein said expanded material is fluorinated ethylene propylene.

28. An air core cable in accordance with claim 21, wherein the total mass of said dielectric tube and said dielectric core with expanded material is in a range of from 50% to 80% of the mass of an equivalent air core coaxial cable filled with expanded material.

29. An air core coaxial cable in accordance with claim 1, wherein said metallic outer shield comprises a metallic foil; and said coaxial cable further comprises a drain wire.

30. An air core coaxial cable in accordance with claim 29, wherein said drain wire is positioned adjacent to said dielectric tube and is enveloped by said metallic foil.

31. An air core coaxial cable in accordance with claim 29, wherein said drain wire is positioned between said metallic foil and said outer jacket.

32. A high signal propagation speed cable in accordance with claim 1, wherein at least one of said cross-section portions includes protruding ribs for contacting an inner surface of said dielectric tube.

* * * * *

UNITED STATES PATENT AND TRADEMARK OFFICE

CERTIFICATE OF CORRECTION

PATENT NO. : 6,849,799 B2
DATED : February 1, 2005
INVENTOR(S) : Springer, Denis D.

It is certified that error appears in the above-identified patent and that said Letters Patent is hereby corrected as shown below:

Column 5,
Line 52, delete "1" and insert -- I -- therefor.

Column 6,
Line 7, delete "1" and insert -- I -- therefor.
Line 66, delete "fluoropolymers" and insert -- fluoropolymers -- therefor.

Column 7,
Line 48, delete "1" and insert -- I -- in both instances.

Column 8,
Line 3, delete "1" and insert -- I -- therefor.
Line 12, delete "1" and insert -- I -- therefor.
Line 14, delete "1" and insert -- I -- therefor.

Column 9,
Line 11, delete "1" and insert -- I -- therefor.
Line 25, after "spacer" insert -- , --.
Line 43, delete "cress-section" and insert -- cross-section -- therefor.
Line 47, after "in" delete "a".

Column 10,
Lines 19-20, delete "fluoropolymers" and insert -- fluoropolymers -- therefor.
Line 46, insert -- An -- before "air".

Signed and Sealed this

Twenty-eighth Day of June, 2005

JON W. DUDAS
*Director of the United States Patent and Trademark Office*